United States Patent [19]

Gunderson

[11] Patent Number: 4,971,372

[45] Date of Patent: Nov. 20, 1990

[54] FLEXIBLE PLASTIC LATCH

[75] Inventor: Jeffrey E. Gunderson, Cottage Grove, Wis.

[73] Assignee: Acry Fab, Inc., Sun Prairie, Wis.

[21] Appl. No.: 513,828

[22] Filed: Apr. 24, 1990

Related U.S. Application Data

[63] Continuation-in-part of Ser. No. 427,047, Oct. 25, 1989, Pat. No. 4,938,513.

[51] Int. Cl.[5] ..... E05C 19/06

[52] U.S. Cl. ..... 292/80; 292/87; 292/DIG. 38

[58] Field of Search ..... 292/DIG. 38, 80, 87, 292/19, 91, 17, 20, 76, DIG. 16, DIG. 61

[56] References Cited

U.S. PATENT DOCUMENTS

| | | | |
|---|---|---|---|
| 86,601 | 2/1869 | Still | 292/87 |
| 269,806 | 12/1882 | McArthur | 292/17 |
| 1,035,666 | 8/1912 | Walpuski et al. | 292/80 |
| 1,076,933 | 10/1913 | Zindel | 292/91 |
| 3,083,046 | 3/1963 | Eberly | 292/87 X |
| 4,462,142 | 7/1984 | Hickling | 403/329 |

FOREIGN PATENT DOCUMENTS

| | | | |
|---|---|---|---|
| 815464 | 10/1951 | Fed. Rep. of Germany | 292/87 |
| 54014 | 11/1946 | France | 292/87 |
| 0785454 | 12/1980 | U.S.S.R. | 292/87 |

*Primary Examiner*—Lloyd A. Gall

*Attorney, Agent, or Firm*—Lathrop & Clark

[57] ABSTRACT

A plastic latch for latching a first surface to a second, substantially coplanar, surface is disclosed having a flexible plastic band with a planar attachment segment adapted for attachment to the first surface, an upper arcuate segment extending upwardly from the attachment segment, a planar first segment depending from the upper arcuate segment and substantially parallel to and longer than the attachment segment, a lower arcuate segment extending from the flex segment beneath the upper arcuate segment, and an engaging segment extending upwardly from the lower arcuate segment parallel to the flex segment and in substantial alignment with the attachment segment. A connecting segment flexibly connects the engaging segment to the attachment segment and extends towards the flex segment. A projecting nub is located on the engaging segment and is adapted to engage beneath the projecting ledge extending from the planar surface when the first surface is placed in contact with the second surface. The flex segment, the arcuate segment, the engaging segment and the connecting segment are adapted to deflect from the first surface if brought into contact with the second surface to enable the nub to engage beneath the ledge. A reinforcing rib may extend from the attachment segment within the band to prevent excessive deflection of the band. The latch may be fabricated entirely of transparent plastic.

13 Claims, 4 Drawing Sheets

FLEXIBLE PLASTIC LATCH

This is a continuation-in-part of application Ser. No. 07/427,047, filed Oct. 25, 1989, U.S. Pat. No. 4,938,513.

FIELD OF THE INVENTION

This invention relates to latches and in particular to flexible plastic latches for boxes.

BACKGROUND OF THE INVENTION

When an article is to be displayed in a protected yet clearly visible fashion it may be placed in a transparent display box. Objects so displayed, be they merchandise, sales samples, works of art, artifacts of historical importance, or other display items, may be approached and inspected at close range while at the same time being protected from dust, air currents, atmospheric conditions, and unwanted handling. Although display boxes may be fabricated of clear glass, transparent plastic, such as acrylic or polycarbonate plastic, is preferred because of its workability and crack resistance. Plastic may be drilled, cut and shaped much more easily than glass and plastic parts may be attached to other plastic parts by means of adhesives or solvent bonding. Plastic display boxes may be constructed entirely of transparent plastic material without any opaque hardware required. What is needed is a latch for such a transparent box that does not introduce a significant visual obstruction into the box. The flexible band latch disclosed in co-pending patent application Ser. No. 07/245,017 is transparent, but requires that a door be closed against a jamb. What is also needed is a latch which can close the cover and base of a box leaving a flush exposed surface.

SUMMARY OF THE INVENTION

The plastic latch for latching a planar member having a first surface to a second member having a substantially coplanar second surface of this invention has a flexible plastic band with a planar attachment segment adapted for attachment to the first surface and an upper arcuate segment extending upwardly from the attachment segment. A planar flex segment depends from the upper arcuate segment and is substantially parallel to and longer than the attachment segment. A lower arcuate segment extends from the flex segment beneath the upper arcuate segment. An engaging segment extends upwardly from the lower arcuate segment and is parallel to the flex segment and in substantial alignment with the attachment segment. A connecting segment flexibly connects the engaging segment to the attachment segment and extends towards the flex segment. A projecting nub is located on the engaging segment and is adapted to engage beneath a projecting ledge extending from the second planar surface when the first member is placed in contact with the second member so the first and second surfaces are substantially coplanar. The flex segment, the arcuate segments, the engaging segment, and the connecting segment are adapted to deflect when the first surface is brought into contact with the second surface to enable the nub to engage beneath the ledge. A reinforcing rib may extend from the engaging segment within the plastic band. The rib is spaced from the band to restrict excessive deformation of the band. A ledge chip having a planar surface and adapted to fit between the engagement segment and the second planar surface may be attached to the second planar surface.

It is an object of the present invention to provide a latch for a box which is substantially transparent.

It is also an object of the present invention to provide a plastic unitary latch to join the lid to the base of a hinged box with a substantially flush front surface.

It is a further object of the present invention to provide a latch for a box that closes with more ease than it opens.

It is a still further object of the present invention to provide a latch which will be quiet in operation.

Yet another object of the present invention is to provide a latch for joining two coplanar surfaces.

These objects and others will become apparent from the following detailed description taken in conjunction with the accompanying drawings wherein a preferred embodiment of the invention has been selected for exemplification.

DESCRIPTION OF THE PREFERRED EMBODIMENTS

Figure 1:
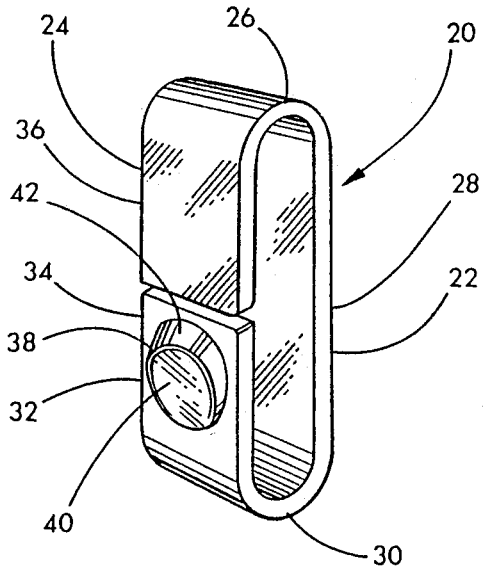
FIG. 1 is a perspective view of the latch of this invention.

Referring now to FIGS. 1–9, wherein like numerals refer to similar parts, the preferred latch 20 includes a flexible plastic band 22 which is roughly in the shape of the letter "C" and has a generally rectangular and uniform cross-sectional shape. The band 22 has an attachment segment 24 which is generally planar, an upper arcuate segment 26 which extends upwardly from the attachment segment 24, a planar flex segment 28 which is longer than the attachment segment 24 and which depends from the upper arcuate segment 26 in substantially parallel relationship to the attachment segment 24, a lower arcuate segment 30 which depends from the flex segment 28, and a planar engaging segment 32 which extends upwardly from the lower arcuate segment 30 in substantially parallel relationship to the flex segment 28 and in general alignment with the attachment segment 24. The engaging segment 32 terminates in close proximity to the attachment segment 24. The front surface 34 of the engaging segment 32 is in substantially the same plane as the front surface 36 of the attachment segment 24. A cam-surfaced nub 38 is affixed to the center of the front surface 34 of the engaging segment 32. The nub 38 may be approximately half the height of the engaging segment 32 and may have a circular cross section at its base. The nub 38 has a closing ramp 40, and an opening ramp 42. The pitch and run of the two ramps may vary depending on the latching strength and ease of opening or closing desired. The opening ramp 42 preferably has a steeper pitch and shorter run than the closing ramp 40. The nub 38 may be affixed to the engaging segment 32 by an adhesive or by a process such as solvent welding, or it may be molded as an integral part of the flexible band 22. The latch 20 may be constructed entirely of polycarbonate plastic material or any other transparent, suitably elastic, plastic material.

Figure 2:
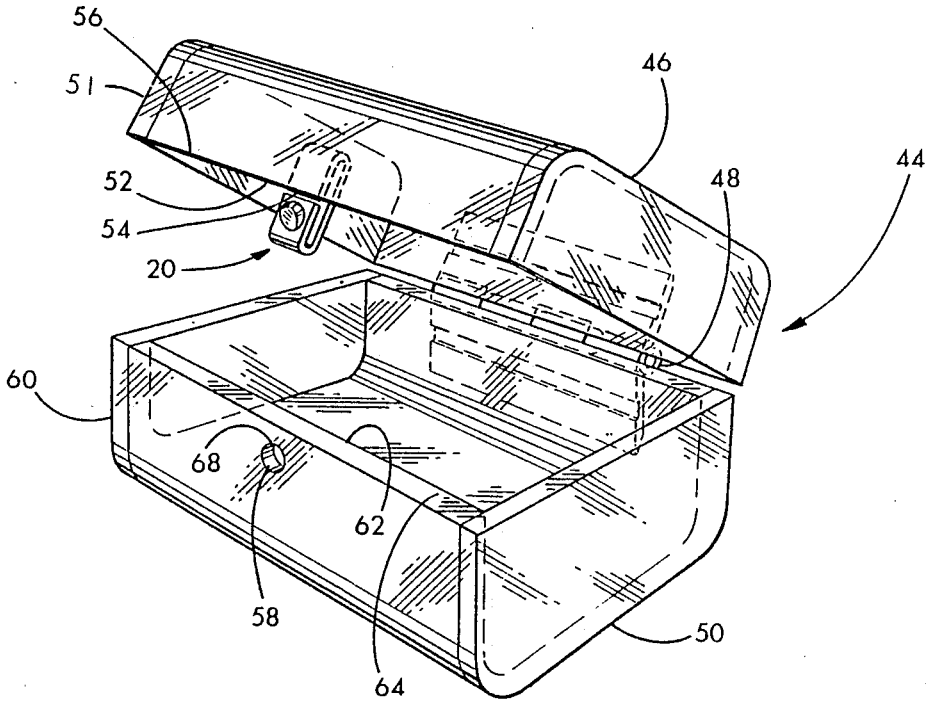
FIG. 2 is a perspective view of the latch of FIG. 1 affixed to an opened display box.
Figure 3:
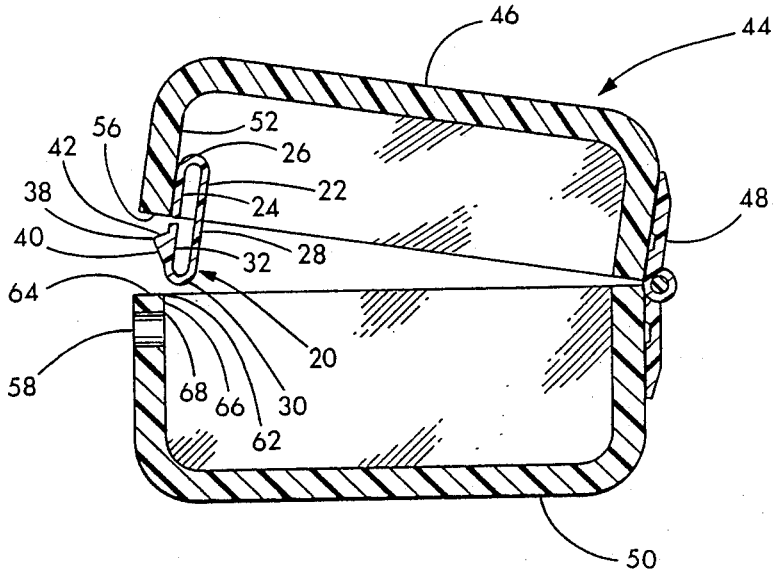
FIG. 3 is a cross sectional view of the display box and latch of FIG. 2 in an opened position.
Figure 4:
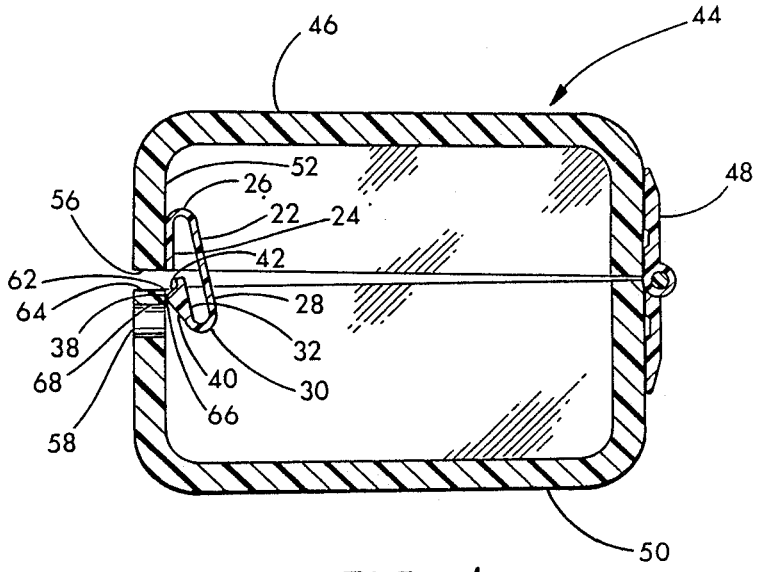
FIG. 4 is a cross sectional view of the display box and latch of FIG. 2 in a partially closed position.

FIG. 2 shows the latch 20 affixed to a transparent plastic box 44. The box has a lid 46 rotatably joined by a hinge 48 to a base 50. When the box is closed the front portion 51 of the lid 46 abuts the front 60 of the base 50 to form a flush exposed front of the box. The latch 20 is affixed by an adhesive or a bonding process to the inner front surface 52 of the lid 46. The attachment section 24 of the latch 20 is affixed to the lid 46 so that the bottom edge 54 of the attachment section 24 aligns with the lid rim 56. The latch 20 is positioned so that, when closed, the nub 38 will be in position to engage the nub hole 58 which is drilled in the front 60 of the base 50. It is not necessary for the nub hole 58 to completely pierce the front 60 of the base 50 so long as it is deep enough to accept the nub 38.

As shown in FIGS. 3–6 the latch 20 of this invention may be used to releasably fix the lid 46 of a box 44 to its base 50. The latch 20 is in its undeformed configuration in FIG. 3 when the lid of the box is open. In this configuration the engaging segment 32 is aligned with the attachment segment 24 and substantially parallel to the flex segment 28. When the box is open the nub 38 of the latch 20 is not in contact with the base 50.

Figure 5:
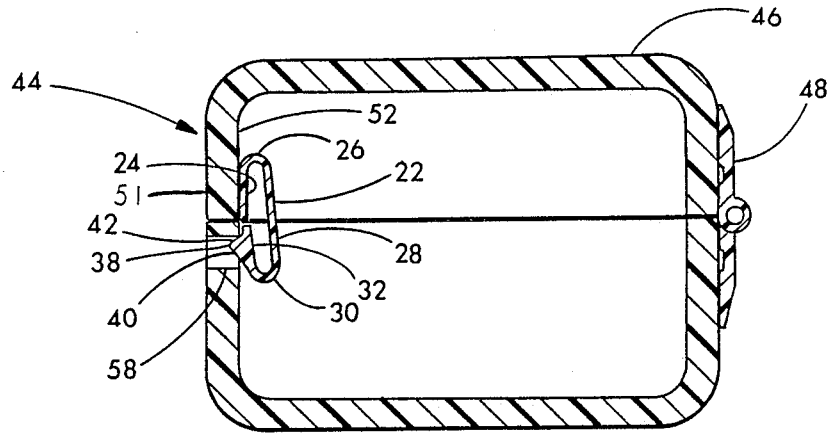
FIG. 5 is a cross sectional view of the display box and latch of FIG. 2 in a closed position.

To close the box 44 the lid 46 is pressed down over the base 50. This pressure brings the closing ramp 40 of the nub 38 into contact with the interior edge 62 of the base rim 64. When contact is made and downward force is continually exerted on the latch 20, the nub 38 is driven down over the interior edge 62 causing the closing ramp 40 to ride inward on the interior edge 62 and thereby flexing the engaging segment 32 and the flex segment 28 as well as the two arcuate segments 26, 30 of the latch 20 until the nub 38 clears the interior edge 62 and rides up on the inner front surface 66 of the base 50. Under continued downward force the nub 38 of the latch 20 rides along the inner front surface 66 until it reaches the nub hole 58, at which point the spring energy of the deflected attachment segment 24 and the flex segment 28 of the latch 20 drive the nub 38 into the nub hole 58. The box is then closed as shown in FIG. 5.

The resilient force of the flexible band 22 acts to keep the nub 38 engaged in the nub hole 58. Any minimal forces, such as jostling of the box, air currents, or vibrations will be resisted by the resilient force of the band 22. This resilient force is generally sufficient to retain the box in a closed configuration even under the force of gravity should the box be lifted by only the lid or overturned.

Figure 6:
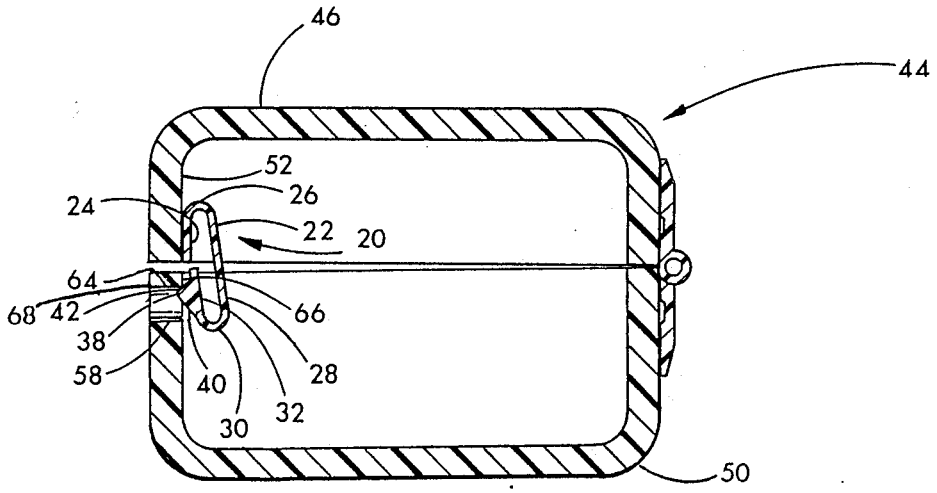
FIG. 6 is a cross sectional view of the display box and latch of FIG. 2 in a partially opened position.

The opening ramp 42 of the nub 38 is more steeply pitched and of shorter run than the closing ramp 40. Thus a greater force applied over a shorter distance is required to open the box than to close it. To open the box 44, the lid 46 is pulled away from the base 50 as shown in FIG. 6. This action causes the opening ramp 42 of the nub 38 to make contact with the upper edge 68 of the nub hole 58. A continued applied force causes the nub 38 to ride inward over the upper edge 68 and onto the inner front surface 66 of the base 50. The nub 38 will then run along the inner front surface 66 until the base rim 64 is cleared. At that point, the lid 46 will be unlatched from the base 50 and the deflected segments of the latch 20 will return to their original configuration as in FIG. 3. In practice, opening and closing of the box 44 equipped with the latch 20 takes place in a very short time and requires a firm but not excessive amount of hand pressure.

A latch constructed according to the present invention effectively extends the length of the "lever arm" which is deflected by engagement of the base 50 and the nub 38. The flex segment 28 deflects from an area high up on the inner surface 52 of the lid 46, and extends to well below the point of application of force against the nub 38. Furthermore, the only portion of the latch 22 that is rigidly fixed to the box during opening and closing is the attachment segment 24 which is fixed to the inner front surface of the cover. The arcuate segments 26, 30 of the band 22 will also deflect when the nub 38 is deflected. Thus, the entire band 22 from the point of application of force at the nub 38 to the fixed attachment segment 24 will act as one continuous spring. This extended, deflectable, combined lever arm made up of the engaging segment 32, the lower arcuate portion 30, the flex segment 28 and the upper arcuate portion 26 not only insures that the opening and closing of the box will not cause plastic deformation, but also makes it easier to latch and unlatch the box 44.

The latch 20 may be constructed to any dimensions within the material limitations of the plastic used, but a latch 20 with a flex segment 28 one inch in length is effective for most small boxes.

Figure 7:
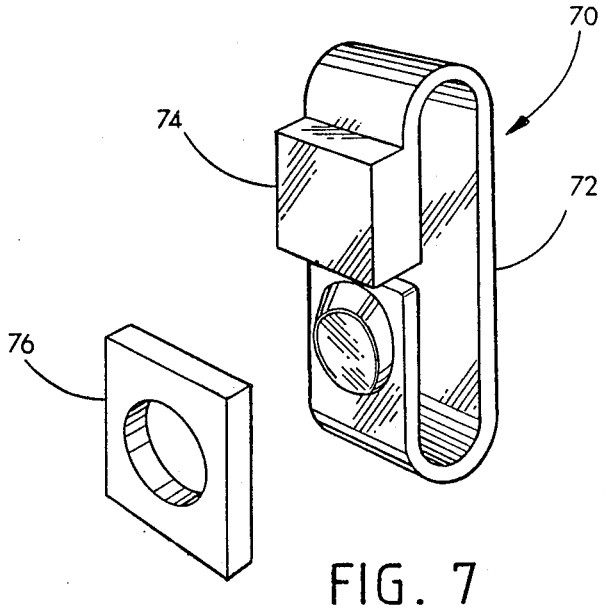
FIG. 7 is an exploded perspective view of a modified form of the latch of this invention having a separate nub hole fixture.

FIG. 7 shows a latch 70 of this invention adapted to be mounted on a box without the need for piercing the base of the box to produce a nub hole. The latch 70 has a flexible band 72 with a double thickness attachment segment 74 and a nub hole chip 76 which may be glued at an appropriate location beneath the latch 70 on the base of a box. The latch 70 is affixed to the inner front surface of the box lid and operates in the same manner as the latch 20.

Figure 8:
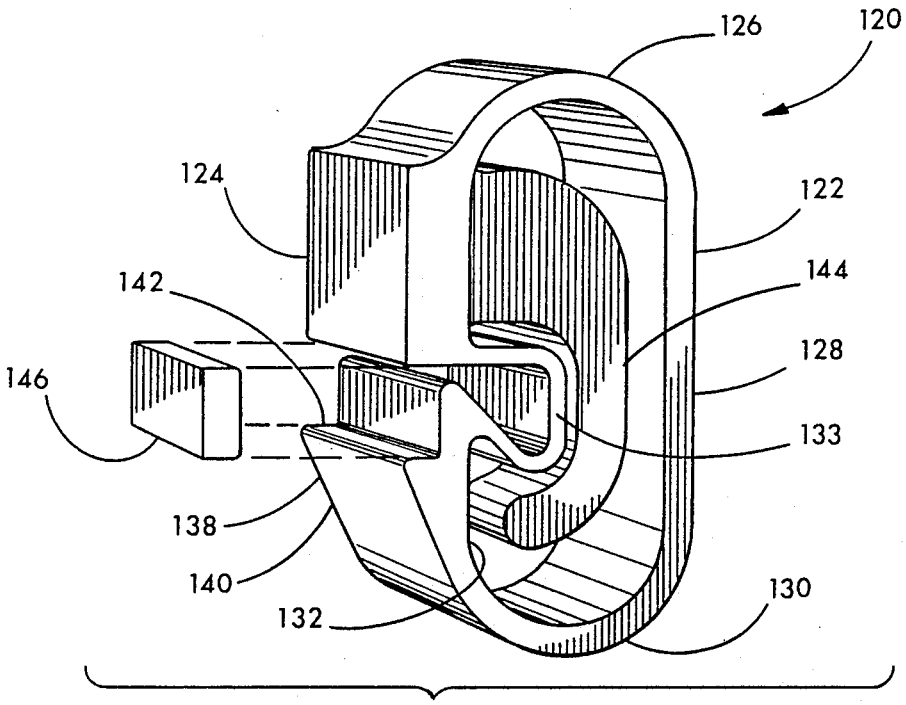
FIG. 8 is an exploded isometric view of a latch of this invention and a ledge chip beneath which the nub of the latch engages.
Figure 9:
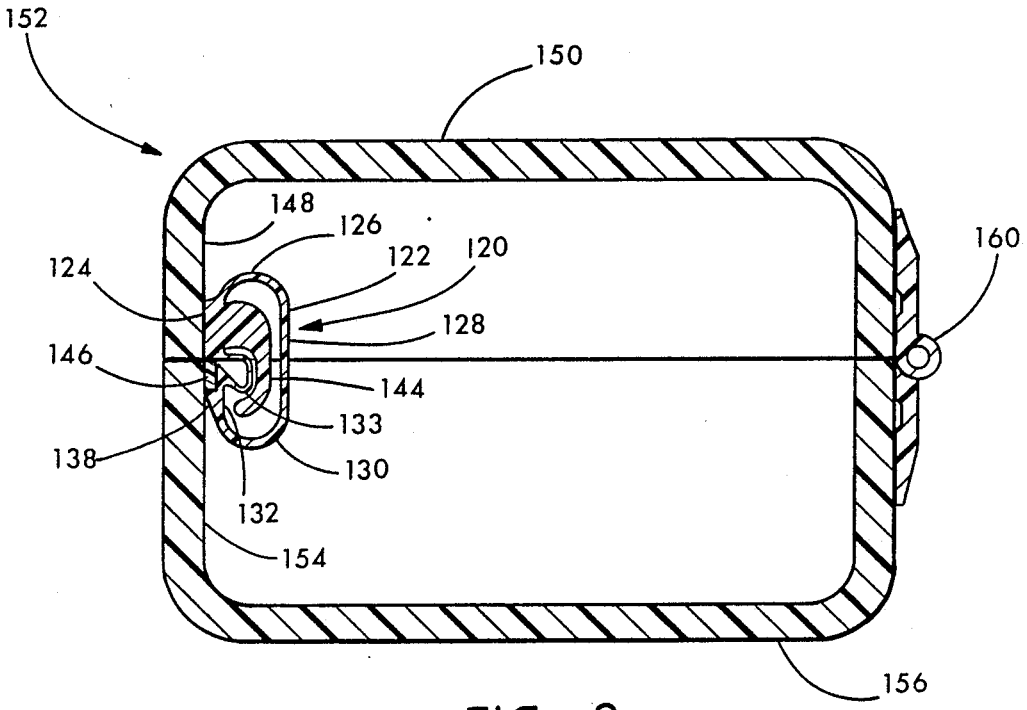
FIG. 9 is a cross-sectional view of the latch and ledge chip of FIG. 8 affixed to a display box in a closed position.

FIGS. 8 and 9 show an alternative embodiment of the latch of this invention adapted to latching two members with planar surfaces to one another. The latch 120 has a continuous flexible plastic band 122 which is preferably formed of transparent plastic. The band 122 has an attachment segment 124 which is generally planar and adapted for attachment to the first of the two surfaces to be latched together. An upper arcuate segment 126 extends upwardly from the attachment segment 124. A generally planar flex segment 128 depends from the upper arcuate segment 126 and is substantially parallel to and longer than the attachment segment 124. A lower arcuate segment 130 extends from the flex segment beneath the upper arcuate segment. An engaging segment 132 extends upwardly from the lower arcuate segment 130 and is parallel to the flex segment 128 and is in substantial alignment with the attachment segment 124.

A generally C-shaped connecting segment 133 flexibly connects the engaging segment 132 to the attachment segment 124. The connecting segment 133 is formed of plastic which is thinner than the plastic forming the other segments of the band 122 and is hence very flexible. The connecting segment 133 extends towards the flex segment 120 within the band and does not significantly restrict the ability of the engaging segment 132 to deflect towards the flex segment when the latch 120 is latched into a closed position. The latch 120 has a projecting nub 138 which is formed on the engaging segment 132 and which extends beyond the surface of the engaging segment.

The nub 138 has a first inclined surface which acts as a closing ramp 140 and a second surface 142 which is generally perpendicular to the plane of the engaging segment 132. A reinforcing rib 144 extends from the attachment segment 124 within the band 122. The reinforcing rib 144 is not as wide as the flexible band 122 and curves around the connecting segment 133. The reinforcing rib 144 is generally thicker than the flexible portions of the flexible band 122. Because of the rib's thickness it is rigid and resistant to elastic deflection. The reinforcing rib 144 is spaced from the band 122 so as not to interfere with the ordinary deflection of the band 122 during latching. The latch 122 together with a ledge chip 146 having a rectangular plan and a constant thickness may be used to latch two planar surface members together. In FIG. 9, the latch 120 and ledge chip 146 are shown latching a first planar surface 148 of a lid 150 of a transparent plastic box 152 to the second planar surface 154 of the base 156 of the box 152. The lid 150 is joined to the base 156 by a hinge 160.

The attachment segment 124 of the latch 120 is attached to the first surface 148 of the lid 150. The attachment segment 124 is the only portion of the latch 120 to be in fixed contact with the surface 148. The thickness of the attachment segment 124 and the distance which it projects beyond the plane of the engaging segment 132 determines the spacing of the nub 138 from the second surface 156. The ledge chip 146 is attached to the second surface on the base 156 so that the ledge chip projects outwardly from the second surface 154. The ledge chip 146 is dimensioned to fit between the engaging segment 132 and the second surface 154 when the lid 150 is closed on the base 156. The attachment segment 124 is dimensioned to space the engaging segment 132 from the first surface 148 to allow the nub 138 to engage beneath the ledge chip 146.

The latch 120 functions substantially as the latch 20 as described above. The connecting segment 133 adds additional rigidity to the band in a direction perpendicular to the surface of the reinforcing rib 144. The reinforcing rib acts to prevent the band from deflecting excessively during closure. The reinforcing rib 144 would, in the case of severe displacement of the engaging segment 132, come in contact with the connecting segment 133 and restrict the band 122 from further deflection. This additional rigidity of the latch 120 is also effective in reducing unwanted vibrations of the band which might produce undesired audible sounds.

The flexible band of the latch of this invention may be made of varying thicknesses to increase or decrease the latching strength of the latch. Likewise the angles and depth of the opening and closing ramps may be varied. The shape of the flexible band may also be varied so long as it retains the essential features of this invention. For example the flex segment may be a sector of a circle or an ellipse and still function as required. The shape of the nub and the nub hole may be other than a circle. A box may be fitted with more than one latch. The latch and nub hole may also be located on the side of a box instead of on the front. The attachment segment may also be mounted on the base of the box with the nub hole located in the lid.

It should be understood that this invention is not limited to the particular construction and arrangement of parts herein illustrated and described, but embodies all such modified forms thereof as come within the scope of the following claims.

I claim:

1. A plastic latch for latching a planar member having a first surface to a second member having a substantially coplanar second surface, comprising:

(a) a flexible plastic band having a planar attachment segment adapted for attachment to the first surface, an upper arcuate segment extending upwardly from the attachment segment, a planar flex segment depending from the upper arcuate segment and substantially parallel to and longer than the attachment segment, a lower arcuate segment extending from the flex segment beneath the upper arcuate segment, and an engaging segment extending upwardly from the lower arcuate segment parallel to the flex segment and in substantial alignment with the attachment segment, and a connecting segment flexibly connecting the engaging segment to the attachment segment and extending towards the flex segment; and (b) a projecting nub on the engaging segment adapted to engage beneath a projecting ledge extending from the second surface when the first surface is placed in coplanar contact with the second surface, the flex segment, the arcuate segments, the engaging segment, and the connecting segment being adapted to deflect when the first member is brought into contact with the second member so that the first and second surfaces are coplanar to enable the nub to engage beneath the ledge.

2. The latch of claim 1 further comprising a reinforcing rib extending from the attachment segment within the plastic band, the rib being spaced from the band to restrict excessive deformation of the band.

3. The latch of claim 1 further comprising a ledge chip having a planar surface and adapted to fit between the engaging segment and the second surface.

4. The latch of claim 1 wherein the nub has an opening surface and an inclined closing ramp.

5. The latch of claim 1 wherein the band and nub are formed out of transparent plastic material.

6. The latch of claim 1 wherein the thickness of the connecting segment is less than the thickness of the other portions of the band.

7. The latch of claim 1 wherein the thickness of the attachment segment is substantially greater than the thickness of the other portions of the band.

8. A plastic latch for a box with a hinged lid having a first planar surface and a base with a second planar surface, comprising:

(a) a flexible plastic band having a planar attachment segment adapted for attachment to the first surface, an upper arcuate segment extending upwardly from the attachment segment, a planar flex segment depending from the upper arcuate segment and substantially parallel to and longer than the attachment segment, a lower arcuate segment extending from the flex segment beneath the upper arcuate segment, and an engaging segment extending upwardly from the lower arcuate segment parallel to the flex segment and in substantial alignment with the attachment segment, and a connecting segment flexibly connecting the engaging segment to the attachment segment and extending towards the flex segment; and (b) a projecting nub on the engaging segment adapted to engage beneath a projecting ledge on the base extending from the second planar surface when the lid is closed on the base, the flex segment, the arcuate segments, the engaging segment, and the connecting segment being adapted to deflect when the lid is closed on the base to enable the nub to engage beneath the ledge.

9. The latch of claim 8 further comprising a reinforcing rib extending from the attachment segment within the band, the rib being spaced from the band to restrict excessive deformation of the band.

10. The latch of claim 8 wherein the nub has an opening surface and an inclined closing ramp.

11. The latch of claim 8 wherein the band and nub are formed out of transparent plastic material.

12. The latch of claim 8 wherein the thickness of the connecting segment is less than the thickness of the other portions of the band.

13. The latch of claim 8 wherein the thickness of the attachment segment is substantially greater than the thickness of the other portions of the band.

* * * * *